US006105586A

United States Patent [19]

Hebenstreit

[11] Patent Number: 6,105,586

[45] Date of Patent: Aug. 22, 2000

[54] CONCEALED ATTACHING CLIP FOR HEADWEAR

[76] Inventor: Marilyn Hebenstreit, 10 Hunters Point, O'Fallon, Ill. 62249

[21] Appl. No.: 09/385,845

[22] Filed: Aug. 30, 1999

[51] Int. Cl.[7] ..... A45D 8/22; A45D 8/00; A45D 8/12; A45D 8/04

[52] U.S. Cl. ..... 132/278; 132/275; 132/276; 132/273

[58] Field of Search ..... 132/278, 276, 132/275, 273, 277, 279, 53; 2/195.1, 199, 207; D28/39–43; D11/75

[56] References Cited

U.S. PATENT DOCUMENTS

| | | | |
|---|---|---|---|
| D. 272,861 | 2/1984 | Incando | D28/93 |
| D. 280,948 | 10/1985 | Smith | D2/230 |
| D. 318,540 | 7/1991 | Carter | D11/75 |
| 4,155,370 | 5/1979 | Nemoto | 132/53 |
| 4,753,252 | 6/1988 | Boxer | 132/48 |
| 4,896,685 | 1/1990 | Lawrence | 132/278 |
| 4,912,944 | 4/1990 | Crosley et al. | 63/29.2 |
| 5,138,720 | 8/1992 | Campbell | 2/207 |
| 5,204,994 | 4/1993 | Herzberg et al. | 2/199 |
| 5,303,724 | 4/1994 | Anzivino | 132/278 |
| 5,575,298 | 11/1996 | Hinton | 132/200 |
| 5,857,469 | 1/1999 | Sowell | 132/275 |

*Primary Examiner*—John J. Wilson
*Assistant Examiner*—Robyn Kieu Doan
*Attorney, Agent, or Firm*—Don W Weber

[57] ABSTRACT

A concealed attaching clip for headwear is disclosed which enables the wearer of a yarmulke or beanie to secure the headwear to a person's hair without the necessity of using a clip which would then be in plain view to the casual observer. The clip includes a covering which is secured to a tensioned clip. The top of the covering has a VELCRO pile fastener secured to it. A VELCRO loop fastener is secured to the inside of the yarmulke or beanie. In order to secure the yarmulke or beanie to a person's head, one simply attaches the lower metal clip to a person's hair and secures the two VELCRO fasteners together. The clip is readily concealable, lightweight, easy to use, and does not in any way damage the often expensive outside of a yarmulke or beanie.

1 Claim, 1 Drawing Sheet

CONCEALED ATTACHING CLIP FOR HEADWEAR

BACKGROUND OF THE INVENTION

This invention relates to the field of headwear. More particularly, it discloses a unique concealed attaching clip for a yarmulke, beanie or similar headwear.

Hat pins, straps, and other devices have been known throughout the headwear field for attaching or securing the headwear to a person's head. A hat pin is a straight pin which is stuck through the hat and wearer's hair and secures the hat to the head. Straps have also been known to be used in this field. Straps are attached to each side of the hat or helmet and tied underneath the chin. This is another method of securing a hat to a person's head.

Other devices have been developed to secure headwear or other articles to a person's head. For example, the 1994 patent issued to Anzivino discloses a barrette anchorage member for a head cover such as a partial wig. The Anzivino device uses a barrette anchorage member folded over fabric which is in turn stitched to the wig support. The barrette is exposed to view once it is in place and Anzivino describes an ornamental figure which may be attached to the outside of the barrette to cover its general appearance.

However, when the wearer of headwear or wig desires the headwear to be secured to the head without it being in obvious view, the barrette type of anchorage will not suffice. It is an object of this invention to supply a means for securing a yarmulke, beanie or other type of cap to a wearer's head where such device is completely concealed from view.

Particularly with respect to very small or thin headwear such as a yarmulke or a beanie, the small or thin headwear will not allow the use of a large barrette, bulky clip, hat pin, strap or other securing means. The small size of the yarmulke or beanie would require a very small securing device. It is another object of this invention to provide a very small and highly concealable clip to attach a very small or thin yarmulke, beanie or other similar headwear to a person's head.

It is common practice to secure a yarmulke or beanie to a person's head by the use of U-shaped tension hairpins. However, these hairpins have the drawback that they may damage the yarmulke or beanie and also necessarily require half of the hairpin to be on the outside of the cap, thus revealing the presence of the securing means. Further, the yarmulke or beanies are often highly decorated and the use of straight pins, hairpins, or other securing means may often damage the highly decorated and expensive outside portion of the yarmulke or beanie. It is a still further object of this invention to provide a lightweight, small, fully concealed securing means for a yarmulke or beanie which does not come into contact with the decorated outside of the yarmulke or beanie and which will not damage the outside of the headwear in any way.

Further and other objects of this invention will become apparent upon reading the below described Specification.

BRIEF DESCRIPTION OF THE DEVICE

This device comprises a small cloth covering for a metal-type clip. The cloth covering has a large rounded head pocket and a smaller rounded toe pocket. The covering has a body which will cover the upper portion of a metal clip. The covering is secured to the head and toe of the metal clip by use of the covering pockets. The head portion of the covering also has a VELCRO hook fastener attached. When a rounded VELCRO pile attaching fastener is attached to the inside of the yarmulke or beanie, the clip and covering may be secured to the inside surface of the yarmulke. The clip device is small, lightweight and fully concealed and does not touch the outer, often more expensive, surface of the yarmulke or beanie.

BRIEF DESCRIPTION OF THE DRAWING FIGURES

DETAILED DESCRIPTION OF THE PREFERRED EMBODIMENT

Figure 3:
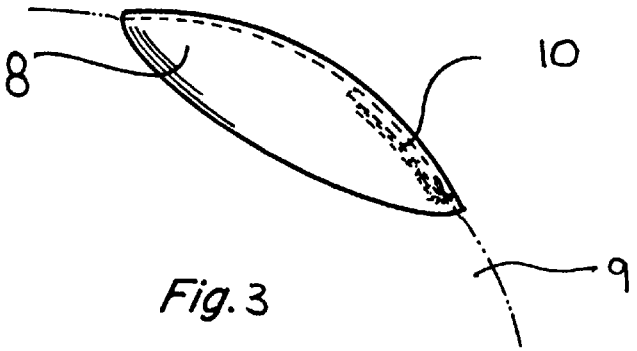
FIG. 3 is a depiction of the person's head with the yarmulke or beanie attached by the clip device.

A cloth covering 1 is produced generally in the shape of the top portion of a metal clip 2. The cloth covering 1 has a toe pocket 4 and a head pocket 5 as shown on FIG. 1 adapted to receive the toe 6' of the metal clip and the head 6 of the metal clip, as shown on FIG. 2.

The cloth covering 1 has the general shape of the upper metal clip body 7 such that the cloth covering 1 will completely cover the upper surface of the metal clip that would otherwise be in contact with the inner surface of the yarmulke or beanie.

Figure 1:
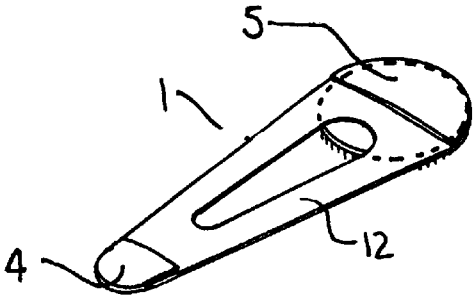
FIG. 1 is a perspective view of the covering of the metal clip.
Figure 2:
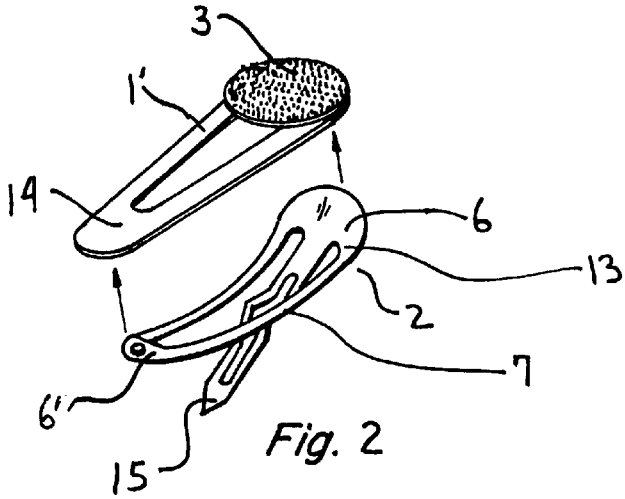
FIG. 2 is a perspective exploded view of the covering and the metal clip, showing their relationship to each other.

The bottom surface 12 of the covering 1 is shown in FIG. 1. This surface 12 is placed against the upper metal surface 13 shown in FIG. 2. The cloth covering embodiment shown in FIGS. 1 and 2 is fastened to the upper metal clip by placing the toe and heel of the clip into the toe and heel pockets, respectively, of the covering.

Attached to the head end of the cloth covering 1 is a rounded VELCRO hook fastener. This fastener is secured on the upper side 14 of the covering opposite the head pocket 5 side, as shown on FIGS. 1 and 2. When the cloth covering 1 is attached to the metal clip 2, the soft cloth surface 14 and the rounded VELCRO head fastener 3 face upwards, as best shown in FIG. 2.

This concealed clip device 10 is intended to concealably fasten a cap such as a yarmulke 8 or beanie. The yarmulke 8 is designed to be fastened to the head 9 of a person, using the clip prong 15 and the person's hair. The device 10 as shown and applied to a yarmulke or beanie is shown in position on FIG. 3.

Figure 4:
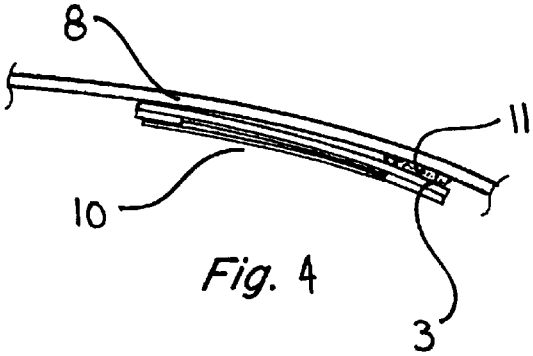
FIG. 4 is a side view of the yarmulke or beanie with the clip device attached to the underside of the headwear.

Turning to FIG. 4, a side view of the device, shown in its attached and concealed position, is illustrated. The concealed attaching clip 10 is placed as shown in FIG. 4 with the rounded VELCRO head fastener 3 facing towards the inner surface of the yarmulke. Attached inside the yarmulke is a rounded VELCRO attaching pile fastener 11. This rounded pile fastener may be attached to the inside of the yarmulke 8 by use of adhesives or by sewing. The concealed clip device 10 is easily and readily attached to a person's hair. The snapping method of attaching the clip prong 15 to a person's hair is well known in the art. Since the prong is tensioned, it readily closes to attach to hair.

The device as shown in FIGS. 1 through 4 is lightweight, soft, readily concealably and readily detachable. When the yarmulke or beanie needs to be washed, the concealed clip device 10 may be removed. In addition, one such cloth covering and metal clip combination would be required for any number of caps since each cap need only have the rounded VELCRO attaching pile fastener 11 attached to the inside of the cap.

The fastener described herein is completely concealable. In addition, because it is made of a cloth covering, it would be comfortable to wear against a person's head. Since the fastener itself is applied only to the inside of the yarmulke or beanie, it will not damage the outer, often expensive and decorated, surface of the headwear.

While this device is designed especially for small beanies or yarmulkes, it could be readily applied to other types of headwear, including caps, hats, or any other type of ornamental or useful device to be attached to the head.

Obviously, the precise kind of clip disclosed herein is meant as a means of illustration of the preferred embodiment only, and not as a limitation. Other types of clips could be utilized in practicing this invention while still keeping within the spirit and disclosure of the invention herein.

In addition, although VELCRO fasteners are preferred, other types of fasteners could be used such as snaps, or buttons and holes.

Further, the covering 1 may be made of cloth, soft vinyl plastic or other material. The means of attaching the covering of to the metal clip is preferred, but the covering may be attached to the clip by other means, such as adhesives. These variations from the preferred embodiment are within the spirit and scope of the disclosure herein.

Having fully disclosed my invention, I claim:

1. A device securing headwear to a person's head comprising:

1. a metal clip having an upper surface and a lower surface, said clip having a broad head end and a narrow toe end, said lower surface having a prong which may be tensioned to secure said clip to a person's hair;
2. a covering having a broad head pocket and a narrow toe pocket shaped coincidentally to the shape of said metal clip, wherein said covering is attached to said clip by placing the head and toe of said clip into the corresponding head and toe pockets of said covering;
3. a hook fastener attached to the upper surface of said covering; and
4. a corresponding pile fastener attached to the inside of said headwear;

whereby said headwear may be detachably secured to a person's head by said device.

* * * * *